US005938513A

United States Patent [19]

Slepikas et al.

[11] Patent Number: 5,938,513

[45] Date of Patent: Aug. 17, 1999

[54] APPARATUS FOR HANDLING POLISHING CARRIERS

[75] Inventors: Michael Slepikas, Phoenix; John Anderson, Mesa, both of Ariz.

[73] Assignee: SpeedFam-IPEC Corp., Chandler, Ariz.

[21] Appl. No.: 08/868,491

[22] Filed: Jun. 3, 1997

[51] Int. Cl.[6] ..... B24B 21/18

[52] U.S. Cl. ..... 451/442; 451/386; 451/391; 451/398; 294/165; 294/166

[58] Field of Search ..... 220/759, 768, 220/769; 294/27.1, 33, 165, 166; 451/286, 287, 288, 289, 290, 385, 386, 391, 398, 442

[56] References Cited

U.S. PATENT DOCUMENTS 5,110,001 5/1992 Dunn .
5,584,520 12/1996 Niemeier ..... 294/34
5,609,376 3/1997 Lardinais et al. .
5,667,265 9/1997 Gebhard ..... 294/27.1
5,704,667 1/1998 Lin ..... 294/15

*Primary Examiner*—Timothy V. Eley
*Attorney, Agent, or Firm*—Snell & Wilmer LLP

[57] ABSTRACT

A carrier carrying device (CCD) for holding a workpiece carrier includes a lower portion and an upper portion coupled to the lower portion. A plurality of shoulder screws are employed to couple the upper and lower portions together; the shoulder screws restrict translational movement of the upper portion to one direction relative to the lower portion. The upper portion includes a flange having a plurality of slots configured to receive a like plurality of engagement members located on the workpiece carrier. A number of springs located between the upper and lower portions cause the flange to engage and secure the engagement members to the CCD. The shoulder screws facilitate alignment of the CCD relative to the workpiece carrier during installation of the CCD.

18 Claims, 6 Drawing Sheets

APPARATUS FOR HANDLING POLISHING CARRIERS

TECHNICAL FIELD

The present invention relates, generally, to systems for lapping, polishing, planarizing, or grinding workpieces such as semiconductor wafers. More particularly, the present invention relates to an apparatus for handling workpiece carriers that support workpieces during processing.

BACKGROUND ART AND TECHNICAL PROBLEMS

The production of integrated circuits begins with the creation of high-quality semiconductor wafers. During the wafer fabrication process, the wafers may undergo multiple masking, etching, and dielectric and conductor deposition processes. Because of the high-precision required in the production of these integrated circuits, an extremely flat surface is generally needed on at least one side of the semiconductor wafer to ensure proper accuracy and performance of the microelectronic structures being created at the wafer surface. As the size of the integrated circuits continues to decrease and the number of microstructures per integrated circuits increases, the need for precise wafer surfaces becomes more important. Therefore, between some processing steps, it may be necessary to polish or planarize the surface of the wafer to obtain the flattest surface possible.

In an exemplary prior art polishing method, one side of the wafer is attached to a flat surface of a wafer carrier or chuck and the other side of the wafer is pressed against a flat polishing surface. To enhance polishing effectiveness, the wafer carrier may be rotated about its vertical axis and oscillated over the inner and outer radial surface of the polishing pad to enhance polishing. Such wafer carriers are known to those skilled in the art and may be employed in a number of processing machines, e.g., a chemical mechanical planarization (CMP) machine.

Wafer carriers may require occasional cleaning, replacement, or repair. Accordingly, technicians may need to remove the wafer carriers from the processing machines and manually handle the individual wafer carriers after they are freed. Many wafer carriers are bulky, heavy (e.g., up to 25 pounds), and difficult to lift, hold, and carry. For example, to lift a wafer carrier from a polishing platform, an operator may hold a portion of the carrier, slide the carrier to an edge of the polishing platform, manually support the carrier by placing his or her hand underneath the carrier, and lift the carrier. Due to the size and weight of the carrier, the operator may be tempted to hold the carrier against his or her body for additional support.

Manually handling a wafer carrier is undesirable for several reasons. For example, touching the lower surface of the carrier may damage the surface or deposit foreign matter onto the surface. If such foreign matter is not removed from the carrier prior to reinstallation, the delicate surfaces of the wafers may be damaged. In addition, touching the polishing surface and sliding the carrier over the polishing surface may damage the lower surface of the carrier and/or the polishing surface.

Manually handling heavy workpiece polishing carriers can be dangerous to the handler and other people or equipment in the working environment. For example, sliding and lifting a bulky carrier may expose the operator's hands and arms to injury. If a carrier is accidentally dropped, then the carrier itself will likely be damaged and surrounding equipment and personnel may be at risk.

SUMMARY OF THE INVENTION

To address the problems associated with manual carrier handling techniques, the present invention provides an apparatus to lift and hold workpiece carriers.

It is an advantage of the present invention that the apparatus facilitates the safe handling of workpiece carriers.

It is a further advantage of the present invention that the apparatus attaches to a top portion of a wafer carrier, allowing an operator to lift and move the carrier without touching the carrier or the precision surface of the carrier.

The above and other advantages are carried out in one form by an apparatus for handling a workpiece carrier having a plurality of drive pins extending therefrom. The apparatus may include a lower portion configured to engage a portion of the workpiece carrier, an upper portion coupled to the lower portion, and a handle connected to the upper portion. The upper portion is capable of translational movement relative to the lower portion, and the upper portion is configured to receive the carrier drive pins to thereby secure the upper portion to the carrier.

BRIEF DESCRIPTION OF THE DRAWING FIGURES

The present invention will hereinafter be described in conjunction with the appended drawing figures, wherein like numerals denote like elements, and:

DETAILED DESCRIPTION OF A PREFERRED EMBODIMENT

The subject invention relates to an apparatus for handling workpiece carriers that may be employed in a number of workpiece processing systems, e.g., CMP systems that process semiconductor wafers. Although the present invention may be compatible with a variety of workpieces that may be exposed to a number of manufacturing processes, the following description refers to semiconductor wafers that require controlled and uniform surface finishes. It will be understood by those skilled in the art, however, that the present invention is not limited to any particular type of workpiece or processing system.

Figure 1:
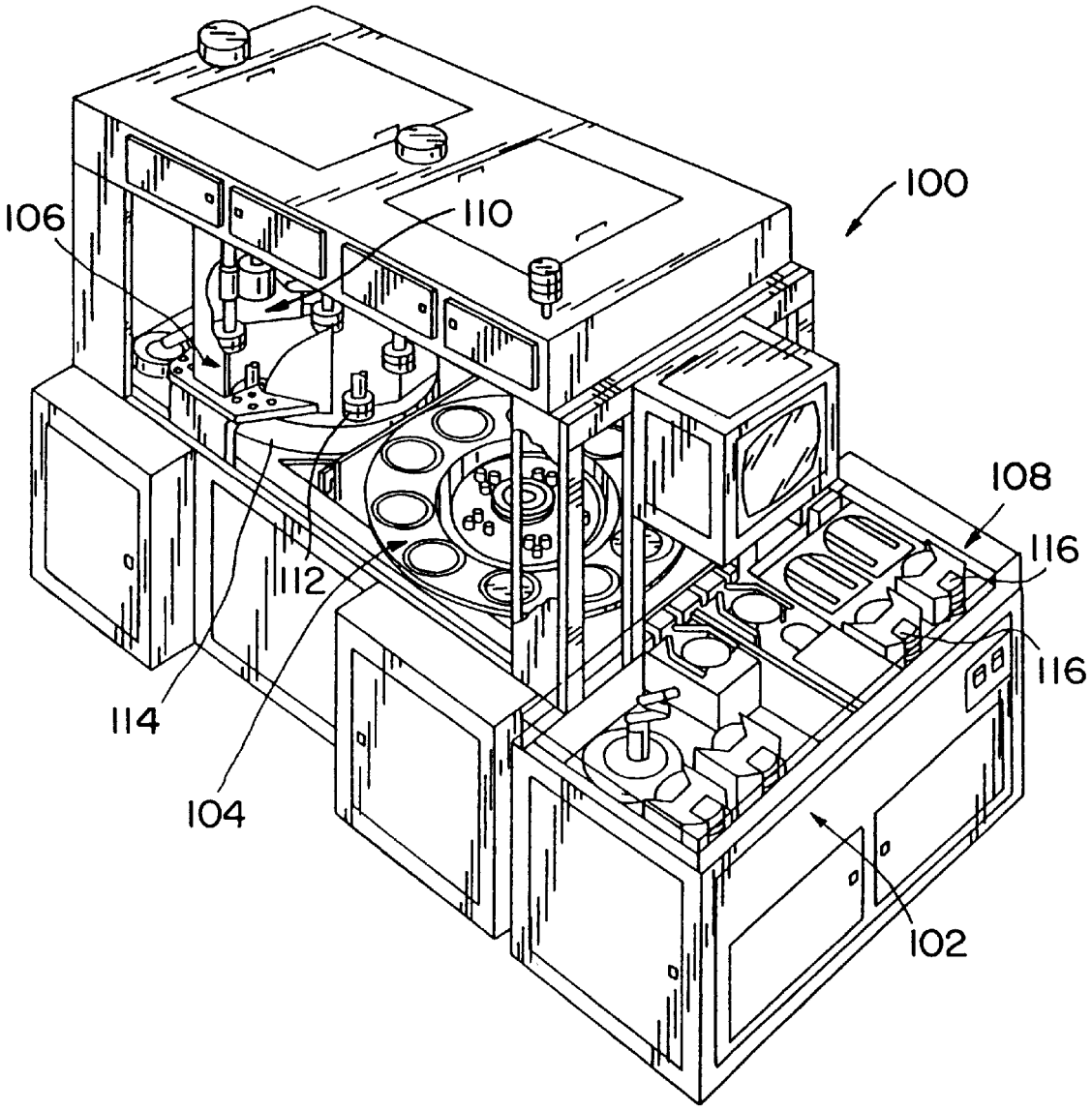
FIG. 1 is a perspective view of an exemplary workpiece polishing system.

FIG. 1 is a perspective view of an exemplary wafer polishing apparatus 100. Wafer polishing apparatus 100 is one example of a workpiece processing system that includes at least one workpiece carrier component. Wafer polishing apparatus 100 generally includes a load station 102, a transition station 104, a polishing station 106, and a rinse/unload station 108. Load station 102 may include any number of devices configured to receive a plurality of wafers (not shown), lift the wafers, and transport the wafers to transition station 104. Transition station 104 may be used to bathe the wafers in deionized water before and after polishing, and to clean the wafers after they have been polished. Transition station 104 may be configured to cooperate with a carrier polishing arm mechanism 110 that receives wafers from transition station 104 for processing and deposits wafers onto transition station 104 after processing.

Carrier polishing arm mechanism 110 suitably includes a number of individual workpiece polishing carriers 112. Each workpiece carrier 112 is configured to hold a wafer during transport to and from transition station 104 and during processing at polishing station 106. Once above polishing station 106, carrier polishing arm mechanism 110 suitably lowers the wafers, which are held by individual workpiece carriers 112, into operative engagement with a polishing platform 114, which rotates during operation. At the same time, workpiece carriers 112 spin the wafers about their respective vertical axes and oscillate the wafers radially inward and outward across polishing platform 114, while pressing the wafers against polishing platform 114 to polish and planarize the wafers.

After an appropriate processing time, carrier polishing arm mechanism 110 transports the wafers back to transition station 104. Carrier polishing arm mechanism 110 then lowers the individual workpiece carriers 112 and the wafers are deposited onto transition station 104. Rinse/unload station 108 may include any number of devices having the necessary configuration and functionality to collect the polished wafers from transition station 104. After a thorough cleaning or rinsing by rinse/unload station 108, the wafers may be loaded into a number of cassettes 116. Cassettes 116 may subsequently be manually or robotically transported to other stations or systems for further processing or packaging of the wafers.

Figure 2:
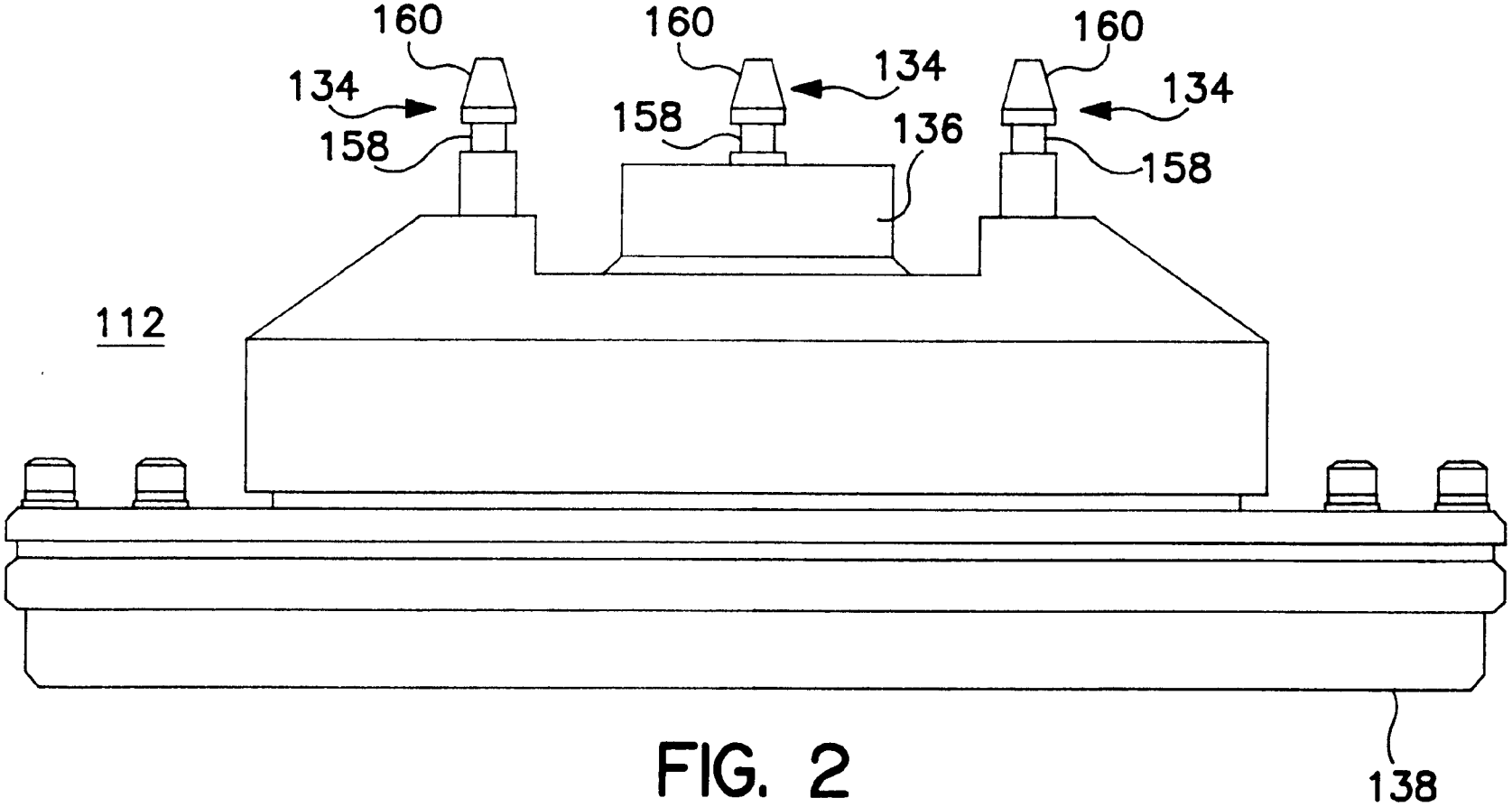
FIG. 2 is a side view of an exemplary workpiece polishing carrier.

Referring now to FIG. 2, workpiece polishing carrier 112 is designed to support a workpiece during processing. Workpiece carrier 112 typically includes a plurality of integral engagement members, e.g., drive pins 134 extending therefrom. Drive pins 134 are preferably configured to allow workpiece carrier 112 to be securely and removably fastened to polishing apparatus 100. Accordingly, the particular size, shape, and physical layout of drive pins 134 may vary according to the corresponding processing machine with which they are compatible. Workpiece carrier 112 may also include a center hub 136, a surface that contacts the workpiece (not shown), and a lower precision surface 138.

Referring now to FIGS. 3–6, a carrier carrying device (CCD) 140 may be used to enable an operator to safely lift, hold, carry, and otherwise handle workpiece carrier 112 as necessary for cleaning, repair, adjustment, or replacement. CCD 140 is preferably configured to engage and couple to workpiece carrier 112 via drive pins 134 such that workpiece carrier 112 can be manually transported. Carrier handle generally includes an upper portion 150, a lower portion 152, and a handle 142. Handle 142 is preferably connected to upper portion 150 such that rotation of handle 142 causes a corresponding rotation of upper portion 150.

Figure 3:
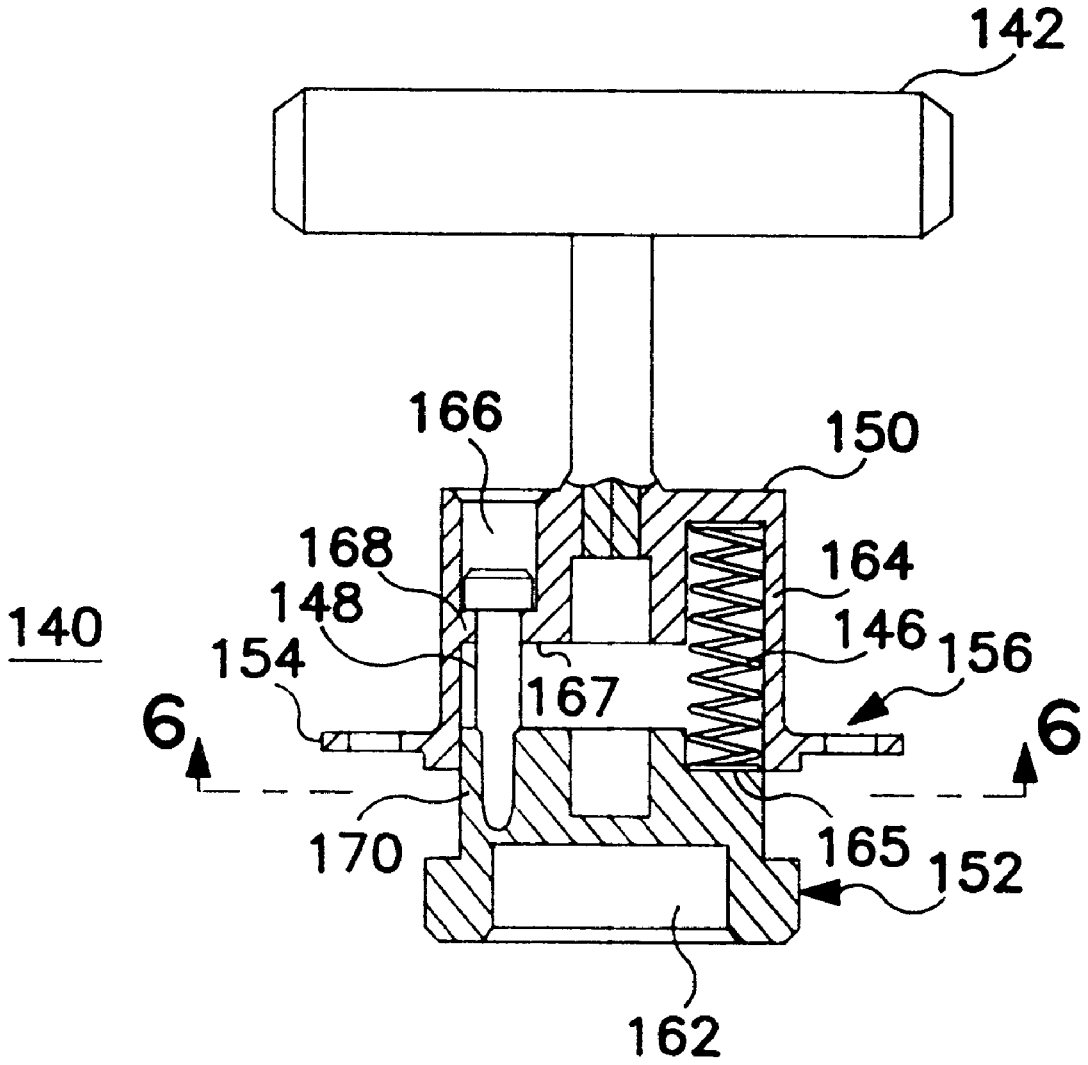
FIG. 3 is a cut-away cross-sectional view of a carrier carrying device (CCD) configured in accordance with the present invention.
Figure 4:
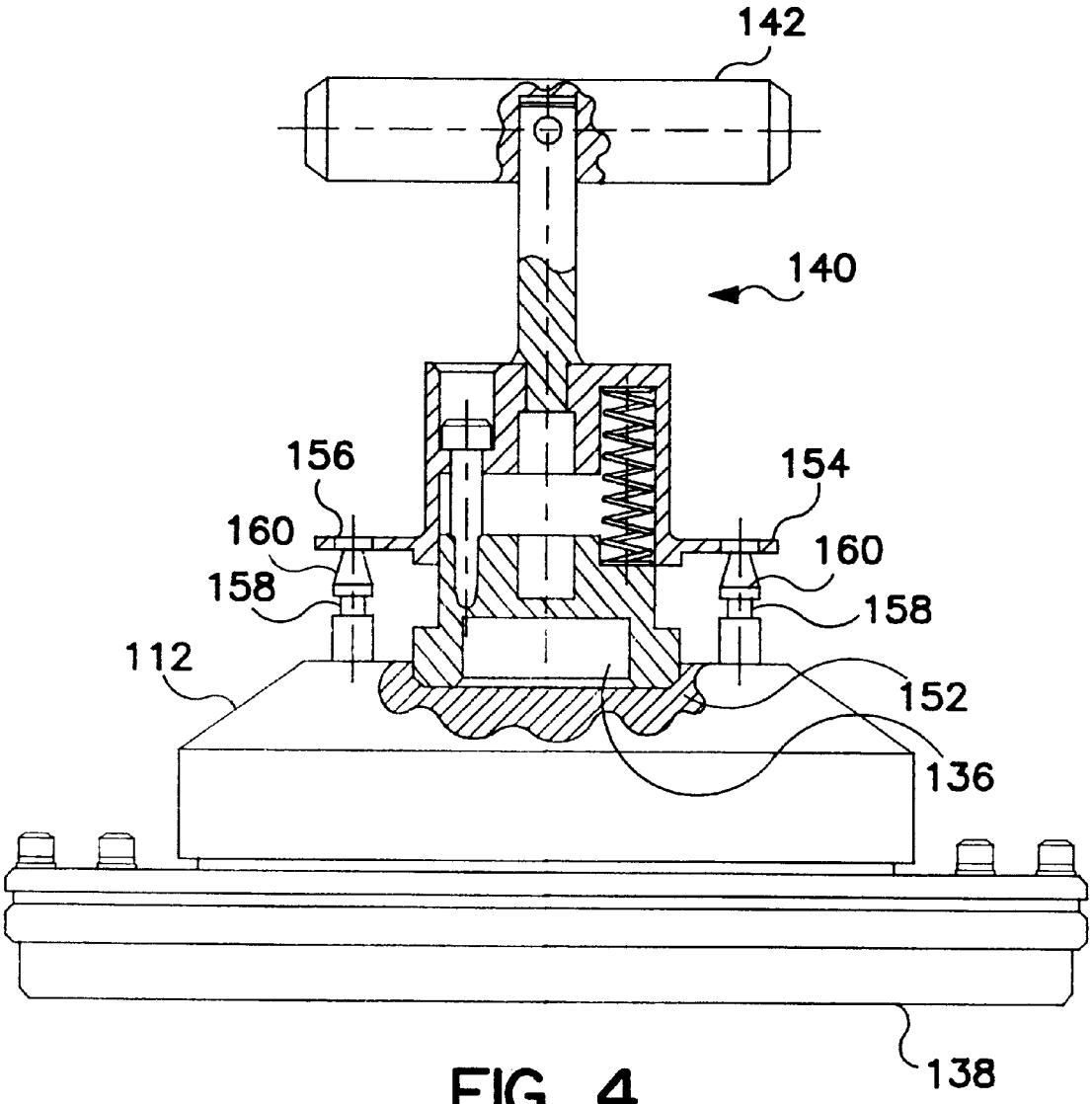
FIG. 4 is a side view of the (disengaged) CCD shown in FIG. 3 along with the carrier shown in FIG. 2.
Figure 5:
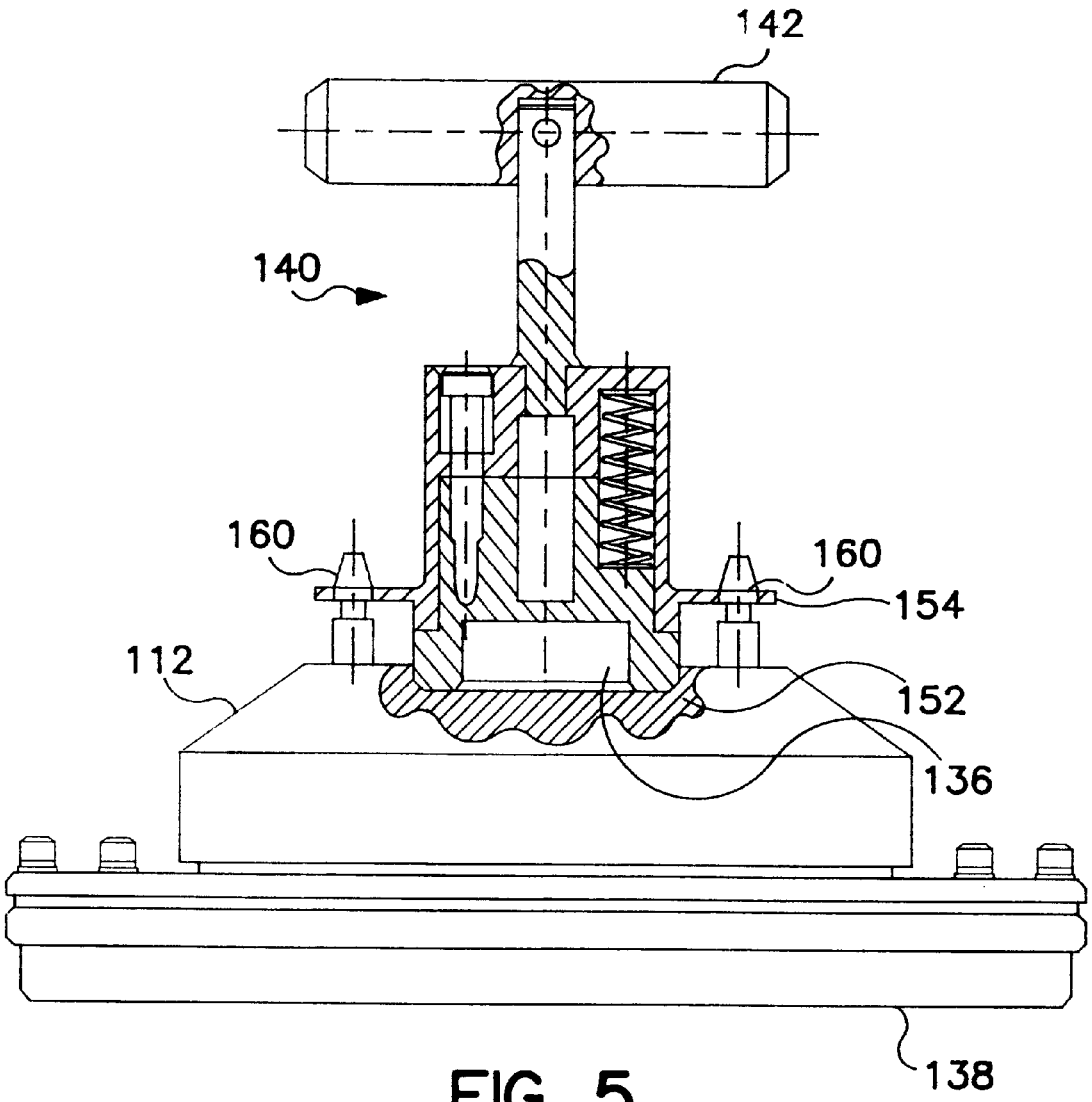
FIG. 5 is a side view of the CCD shown in FIG. 3 along with the carrier shown in FIG. 2, wherein the CCD is engaged with the carrier.

Lower portion 152 is preferably configured to engage a portion of workpiece carrier 112, e.g., center hub 136 (see FIGS. 4–5). In the exemplary embodiment shown, a center cavity 162 (see FIG. 3) formed within lower portion 152 of CCD 140 is sized to receive center hub 136. Center cavity 162 cooperates with center hub 136 to facilitate proper alignment of CCD 140 relative to drive pins 134.

Figure 7:
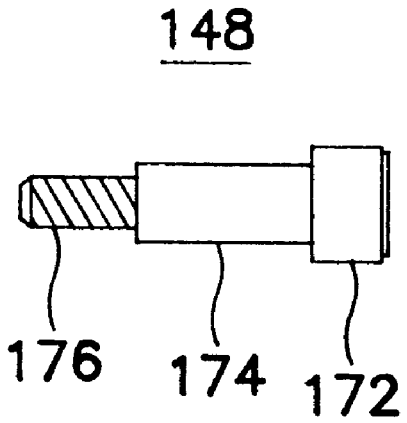
FIG. 7 is a side view of a shoulder screw employed by the CCD.

Upper portion 150 is coupled to lower portion 152 via a plurality of shoulder screws 148 (see FIG. 7). As shown in FIG. 3, each shoulder screw 148 is preferably secured to lower portion 152 by suitable engagement with a threaded cavity 170. The preferred embodiment utilizes three evenly spaced shoulder screws 148 to couple upper and lower portions 150, 152 together. Shoulder screws 148 are configured to enable upper and lower portions 150, 152 to move or slide in a translational manner relative to each other. In addition, shoulder screws 148 substantially restrict translational movement of upper portion 150 to one direction relative to lower portion 152 (e.g., vertically up and down in FIGS. 4–5). It should be appreciated that CCD 140 may alternatively employ any suitable coupling elements known to those skilled in the art.

Referring now to FIGS. 3–5 and 7, shoulder screws 148 help prevent upper portion 150 from tilting relative to lower portion 152 during operation of CCD 140, e.g., when downward force is applied to handle 142. Shoulder screws 148 may be formed of any rigid material; in the preferred embodiment, shoulder screws 148 are formed of stainless steel. Shoulder screws 148 preferably include substantially concentric cylindrical portions, including a top portion 172, a shoulder portion 174, and a threaded end portion 176 configured to couple to lower portion 152 of CCD 140. In the preferred embodiment, the width of top portion 172 is greater than the width of shoulder portion 174.

For each shoulder screw 148, a cavity 166 (see FIG. 3) formed within upper portion 150 is configured to receive top portion 172; the width of cavity 166 is slightly greater than the width of top portion 172 to allow top portion 172 to move, relative to upper portion 150, within cavity 166. A hole 168 is formed within a base 167 of cavity 166; hole 168 is sized to receive shoulder portion 174. Accordingly, the width of hole 167 is greater than the width of shoulder portion 174 and less than the width of top portion 172 such that top portion 172 cannot pass through hole 168. In other words, contact between top portion 172 and base 167 limits upward movement of upper portion relative to lower portion 152. As described above, threaded cavity 170 is configured to receive end portion 176.

In the preferred embodiment, CCD 140 includes a plurality of springs 146 for upwardly biasing upper portion 150 relative to lower portion 152. Each of springs 146 is approximately 50 millimeters long (uncompressed) and exerts a force of approximately 0.80 N/mm. Of course, those skilled in the art will appreciate that CCD 140 may utilize any number of springs 146 or alternately employ any suitable biasing element to accomplish substantially the same results.

As best shown in FIG. 3, springs 146 are located between upper and lower portions 150, 152. For each spring 146, upper portion 150 includes an upper spring seat 164 formed therein and lower portion 152 includes a lower spring seat 165 formed therein. Each cooperating pair of upper and lower spring seats 164, 165 are substantially aligned with one another, i.e., upper and lower spring seats 164, 165 share a common longitudinal axis. When CCD 140 is assembled, each spring 146 resides within cooperating upper and lower spring seats 164, 165.

Upper portion 150 is configured to receive drive pins 134 of workpiece carrier 112 to thereby secure upper portion 150 to workpiece carrier 112. In particular, upper portion 150 preferably includes an outer flange 154 having a plurality of slots 157 formed therein (see FIG. 6). Each slot 157 has an entry aperture 156 and a neck region 159 connected to entry aperture 156. To facilitate effective coupling with drive pins 134, the width of entry aperture 156 is greater than the width of neck region 159. Each neck region 159 may terminate in a recessed locking pocket 155 (shown in phantom in FIG. 6) that receives head portion 160 of drive pin 134. Locking pockets 155 are located on the upper surface of outer flange 154 and preferably have a depth between 0.5 and 1.5 mm. Locking pockets 155 are configured to allow drive pins 134 to seat within outer flange 154 to prevent rotation of upper portion 150 relative to lower portion 152 after engagement.

CCD 140 couples to workpiece carrier 112 by securing a head portion 160 of drive pin 134 above flange 154 while springs 146 cause flange 154 to exert an upward force on head portion 160. Each drive pin 134 includes a neck portion 158 connected to head portion 160. To facilitate proper coupling of CCD 140, the width of head portion 160 is less than the width of entry apertures 156 and greater than the width of neck region 157.

Figure 6:
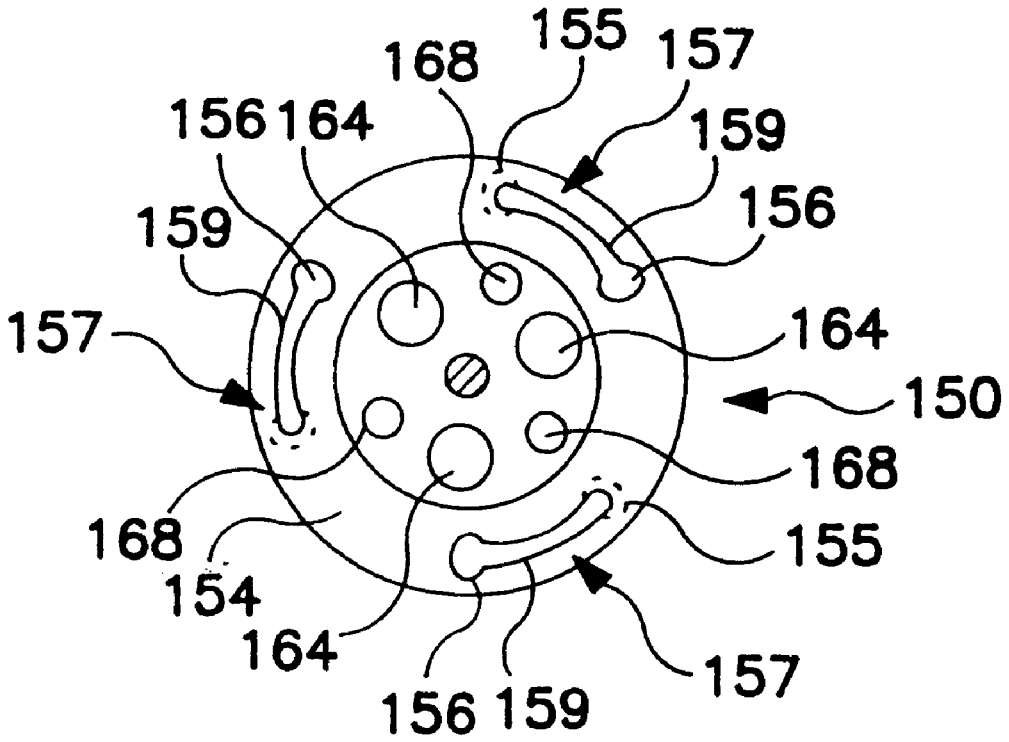
FIG. 6 is a plan view of an upper portion of the CCD as viewed from line 6—6 in FIG. 3.

To operate CCD 140, a user positions it as shown in FIG. 4, i.e., such that center hub 136 is aligned with center cavity 162 and drive pins 134 are aligned with entry apertures 156. Next, a downward force is applied to handle 142 to suitably compress springs 146 such that drive pins 134 protrude through entry apertures 156 (see FIG. 5). The operator then rotates handle 142 to thereby cause upper portion 150 to rotate relative to drive pins 134. Rotation of upper portion 150 causes neck portions 158 of drive pins 134 to enter neck region 159 of slots 157. As shown in FIG. 6, slots 157 are arcuately shaped to facilitate rotation of upper portion, relative to drive pins 134, when drive pins are received within slots 157. When the operator removes the downward pressure on handle 142, springs 146 urge flange 154 against head portions 160 of drive pins 134. The tension of springs 146 keeps CCD 140 coupled to workpiece carrier 112 until the operator reverses the installation procedure.

In summary, the present invention provides a carrier handle for lifting, carrying, and holding workpiece carriers. The carrier handle facilitates the safe handling of workpiece carriers and allows an operator to lift and move workpiece carriers without actually touching the carriers or the precision surfaces of the carriers.

The present invention has been described above with reference to a preferred embodiment. However, those skilled in the art will recognize that changes and modifications may be made to the preferred embodiment without departing from the scope of the present invention. In addition, the present invention is not limited to operation with the specific carrier element shown and described herein, and the present invention may be suitably modified for compatibility with different workpiece polishing carriers and other workpiece processing equipment. These and other changes or modifications are intended to be included within the scope of the present invention, as expressed in the following claims.

What is claimed is:

1. An apparatus for handling a workpiece carrier having a plurality of drive pins extending therefrom, said apparatus comprising:

a lower portion configured to engage a portion of said workpiece carrier;

an upper portion coupled to said lower portion and capable of translational movement relative to said lower portion, said upper portion being configured to receive said drive pins to thereby secure said upper portion to said workpiece carrier; and a handle, connected to said upper portion, for carrying and manipulating said workpiece carrier.

2. An apparatus according to claim 1, wherein said upper portion further comprises:

an outer flange; and a plurality of slots formed within said outer flange and configured to receive said drive pins.

3. An apparatus according to claim 2, wherein each of said slots are arcuately shaped to facilitate rotation of said upper portion, relative to said drive pins, when said drive pins are received within said slots.

4. An apparatus according to claim 2, wherein:

each of said slots comprises an entry aperture having a width and a neck region having a width, said neck region connected to said entry aperture; and the width of said entry aperture is greater than the width of said neck region.

5. An apparatus according to claim 1, further comprising means for upwardly biasing said upper portion relative to said lower portion.

6. An apparatus according to claim 5, wherein said means for upwardly biasing comprises a spring located between said upper and lower portions.

7. An apparatus according to claim 6, wherein:

said upper portion includes an upper spring seat formed therein;

said lower portion includes a lower spring seat formed therein, said lower spring seat being substantially aligned with said upper spring seat; and said spring resides within said upper and lower spring seats.

8. An apparatus according to claim 1, further comprising a shoulder screw for coupling said upper portion to said lower portion, said shoulder screw being configured to align said upper and lower portions and to facilitate slidable engagement of said upper and lower portions.

9. An apparatus according to claim 8, wherein:

said shoulder screw comprises a top portion having a width, a shoulder portion having a width, and an end portion configured to couple to said lower portion, wherein the width of said top portion is greater than the width of said shoulder portion; and said upper portion comprises:

a cavity formed therein for receiving said top portion, said cavity having a base; and a hole formed within said base, said hole having a width, said hole being configured to receive said shoulder portion, wherein the width of said hole is greater than the width of said shoulder portion and less than the width of said top portion.

10. An apparatus according to claim 9, wherein contact between said top portion and said base limits upward movement of said upper portion relative to said lower portion.

11. An apparatus for lifting and holding a workpiece carrier, said apparatus comprising:

upper and lower portions configured for slidable engagement relative to each other;

means for coupling said upper and lower portions together, said means for coupling being configured to substantially restrict translational movement of said upper portion to one direction relative to said lower portion;

means for removably securing one of said upper and lower portions to said workpiece carrier, said means for removably securing comprising a plurality of slots formed within said upper portion, said slots being configured to receive a corresponding plurality of engagement members integral to said workpiece carrier; and a handle connected to said upper portion.

12. An apparatus according to claim 11, wherein:

each of said slots are arcuately shaped to facilitate rotation of said upper portion, relative to said engagement members; and said handle is connected to said upper portion such that rotation of said handle causes a corresponding rotation of said upper portion.

13. An apparatus according to claim 11, wherein;

each of said slots comprises an entry aperture having a width and a neck region having a width, said neck region connected to said entry aperture; and the width of said entry aperture is greater than the width of said neck region.

14. An apparatus according to claim 13, wherein:

each of said engagement members includes a head portion having a width and a neck portion having a width, said neck portion connected to said head portion; and the width of said head portion is less than the width of said entry aperture and greater than the width of said neck region.

15. An apparatus for lifting and holding a workpiece carrier, said apparatus comprising:

upper and lower portions configured for slidable engagement relative to each other;

means for coupling said upper and lower portions together, said means for coupling being configured to substantially restrict translational movement of said upper portion to one direction relative to said lower portion;

means for removably securing one of said upper and lower portions to said workpiece carrier;

a plurality of springs located between said upper and lower portions, said springs being arranged to upwardly bias said upper portion relative to said lower portion; and a handle connected to said upper portion.

16. An apparatus according to claim 15, wherein:

said upper portion includes a plurality of upper spring seats formed therein;

said lower portion includes a like plurality of lower spring seats formed therein, each of said lower spring seats being substantially aligned with a corresponding one of said upper spring seats; and each of said springs resides within one of said upper spring seats and one of said lower spring seats.

17. An apparatus for lifting and holding a workpiece carrier, said apparatus comprising:

upper and lower portions configured for slidable engagement relative to each other;

means for coupling said upper and lower portions together, said means for coupling being configured to substantially restrict translational movement of said upper portion to one direction relative to said lower portion;

means for removably securing one of said upper and lower portions to said workpiece carrier;

a shoulder screw for coupling said upper portion to said lower portion, said shoulder screw being configured to limit upward movement of said upper portion relative to said lower portion, said shoulder screw comprising a top portion having a width, a shoulder portion having a width, and an end portion configured to couple to said lower portion, wherein the width of said top portion is greater than the width of said shoulder portion; and a handle connected to said upper portion; wherein said upper portion comprises:

a cavity formed therein for receiving said top portion, said cavity having a base; and a hole formed within said base, said hole having a width, said hole being configured to receive said shoulder portion, wherein the width of said hole is greater than the width of said shoulder portion and less than the width of said top portion.

18. An apparatus according to claim 17, wherein said shoulder screw aligns said upper and lower portions and facilitates slidable engagement of said upper and lower portions.

* * * * *